US010487619B2

(12) United States Patent
Kandaswami

(10) Patent No.: US 10,487,619 B2
(45) Date of Patent: Nov. 26, 2019

(54) METHODS AND SYSTEMS FOR A SEALING A WELLBORE

(71) Applicant: Aravind Kandaswami, Kingwood, TX (US)

(72) Inventor: Aravind Kandaswami, Kingwood, TX (US)

( * ) Notice: Subject to any disclaimer, the term of this patent is extended or adjusted under 35 U.S.C. 154(b) by 118 days.

(21) Appl. No.: 15/862,736

(22) Filed: Jan. 5, 2018

(65) Prior Publication Data

US 2018/0195364 A1 Jul. 12, 2018

Related U.S. Application Data

(60) Provisional application No. 62/443,201, filed on Jan. 6, 2017.

(51) Int. Cl.

| | |
|---|---|
| ***E21B 23/06*** | (2006.01) |
| ***E21B 33/134*** | (2006.01) |
| ***E21B 34/06*** | (2006.01) |

(52) U.S. Cl.
CPC ..... *E21B 33/134* (2013.01); *E21B 23/06* (2013.01); *E21B 34/066* (2013.01)

(58) Field of Classification Search
CPC ..... E21B 23/06; E21B 34/066; E21B 33/134; E21B 33/127
See application file for complete search history.

(56) References Cited

U.S. PATENT DOCUMENTS

| | | | | |
|---|---|---|---|---|
| 3,460,618 A * | 8/1969 | Blagg | E21B 23/06 166/184 |
| 6,341,654 B1 * | 1/2002 | Wilson | E21B 33/1275 166/387 |
| 2017/0275962 A1 * | 9/2017 | Conzemius | E21B 23/06 |

* cited by examiner

*Primary Examiner* — David J Bagnell
*Assistant Examiner* — Dany E Akakpo
(74) *Attorney, Agent, or Firm* — Pierson IP, PLLC

(57) ABSTRACT

Embodiments disclosed herein describe a resettable bridge plug that is configured to isolate a section of a wellbore. Embodiments may be utilized in fracturing a wellbore, wherein the same bridge plug may be set and released at different locations for multiple cycles with a wireline run.

16 Claims, 8 Drawing Sheets

METHODS AND SYSTEMS FOR A SEALING A WELLBORE

CROSS-REFERENCE TO RELATED APPLICATIONS

This application claims a benefit of priority under 35 U.S.C. § 119 to Provisional Application No. 62/443,201 filed Jan. 6, 2017, which is fully incorporated herein by reference in its entirety.

BACKGROUND INFORMATION

Field of the Disclosure

Examples of the present disclosure relate methods and systems associated with a resettable bridge plug. More specifically, embodiments a resettable bridge plug that is configured to be set and unset based on a pressure differential between a fill chamber and well bore pressure.

Background

A bridge plug is a tool that is set downhole to isolate portions of a wellbore. Bridge plugs are typically set by pumping it using a driving fluid through the wellbore. Once in place, the bridge plug may be set. Setting the bridge plug may include expanding slips or seals for anchoring and sealing of the bridge plug, respectively. Once anchored and sealed, a perforation application may take place above the bridge plug, so as to provide perforations through the casing in the isolated section of the wellbore above the bridge plug. This process is then completed multiple times with different bridge plugs within the wellbore. Bridge plugs are also used to plug and abandon a well, temporarily or permanently.

Unfortunately, unlike setting of the bridge plug, it is difficult to remove a bridge plug from a wellbore. As a result, removal of a bridge plug requires drilling out the bridge plug from the wellbore.

Accordingly, needs exist for system and methods for a resettable bridge plug, wherein the bridge plug may be repositioned at a different location within a casing without being extracted from the wellbore.

SUMMARY

Embodiments disclosed herein describe a resettable bridge plug that is configured to isolate a section of a wellbore. Embodiments may be utilized in fracturing a wellbore, wherein the same bridge plug may be set and released at different locations for multiple cycles within a wireline run. Embodiments may also be utilized to detect casing leaks by set and release the bridge plug at desired locations to pinpoint a location of the casing leak. Additionally, embodiments may be utilized to open and close multiple sleeves within the single wireline run based on a created pressure differential within a tool.

Embodiments may include a solenoid valve, pathway, fill chamber, piston, spring chamber, packers, slips, and filter.

The solenoid valve may be connected to a wireline, and be configured to operate as a barrier between the well and an inner diameter of the bridge plug. The solenoid valve may be configured to open and close to allow fluid to enter and exit the fill chamber via the pathway. In embodiments, responsive to activating the solenoid valve fluid may enter the fill chamber and pulling on the wireline, and responsive to deactivating the solenoid valve the fluid may exit the fill chamber, which may expose equalizing ports and unset the plug. In embodiments, the solenoid valve may act as a one way valve, wherein the solenoid valve obstructs the flow of fluid when the solenoid valve is deactivated. Furthermore, the wireline may be configured to deactivate the solenoid valve by receiving a load via the wireline, which may unset the bridge plug.

The pathway may be a gun drilled hole through the bridge plug that extends from the solenoid valve to the fill chamber. The pathway may be configured to allow fluid, such as hydrostatic fluid, to flow into the fill chamber.

The fill chamber may be a compartment, cavity, etc. positioned at the distal end of the pathway. The fill chamber may be configured to receive the fluid through the pathway to increase the pressure within the fill chamber. Responsive to the pressure within the fill chamber being increased, via the received fluid, the pressure creates a pulling force on the piston to move the piston towards the proximal end of the bridge plug, setting the elements of the bridge plug. For example, packers may radially expand across an annulus to perform a fracking operation. Responsive to deactivating the solenoid valve and pulling on a wireline, a check valve associated with the fill chamber may be opened, allowing the fluid within the fill chamber to exit the fill chamber. This may allow the piston to move towards the distal end of the bridge plug.

The spring chamber may be positioned between the piston and the solenoid valve. The spring chamber may be configured to be filled with inert gas, such as nitrogen. In embodiments, a pressure differential between a first pressure within the fill chamber and a second pressure within the spring chamber may be configured to create a resistant force or moving force on the piston. The resistant force limits the movement of the piston towards the proximal end of the bridge plug, while the moving force allows the piston to move towards the proximal end of the bridge plug. Responsive to the first pressure being greater than the second pressure, the piston may move towards the proximal end of the bridge plug and set the elements associated with the bridge plug. Responsive to the first pressure decreasing, the piston may move towards the distal end of the bridge plug and unset the elements associated with the bridge plug. Furthermore, the resistant force created by the spring chamber may be configured to assist in maintaining the elements of bridge plugs in an unset formation until the solenoid valve is activated.

The packers may be sealing elements that are configured to seal radially. In embodiments, while the solenoid valve is deactivated, the packers may not seal across an annulus. While the solenoid valve is activated, the packers may be configured to seal across the annulus, wherein the packers are set based on the pressure differential.

The slips may be positioned more proximate to the distal end of the bridge plug than the packers. The slips may be configured to extend across the annulus to form an anchor for the bridge plug within casing. The slips may include vertically adjustable members, such as springs, that are configured to assist in unsetting the slips. While the solenoid valve is activated, the slips may be configured to be set, wherein the slips are set based on the pressure differential.

The filter may be a device that is configured to filter, remove, limit, etc. undesirable elements from entering the bridge plug from the annulus. In embodiments, the filter may be positioned at a location through the outer diameter of the bridge plug corresponding to the solenoid valve.

These, and other, aspects of the invention will be better appreciated and understood when considered in conjunction with the following description and the accompanying drawings. The following description, while indicating various embodiments of the invention and numerous specific details thereof, is given by way of illustration and not of limitation. Many substitutions, modifications, additions or rearrangements may be made within the scope of the invention, and the invention includes all such substitutions, modifications, additions or rearrangements.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

Figure 1:
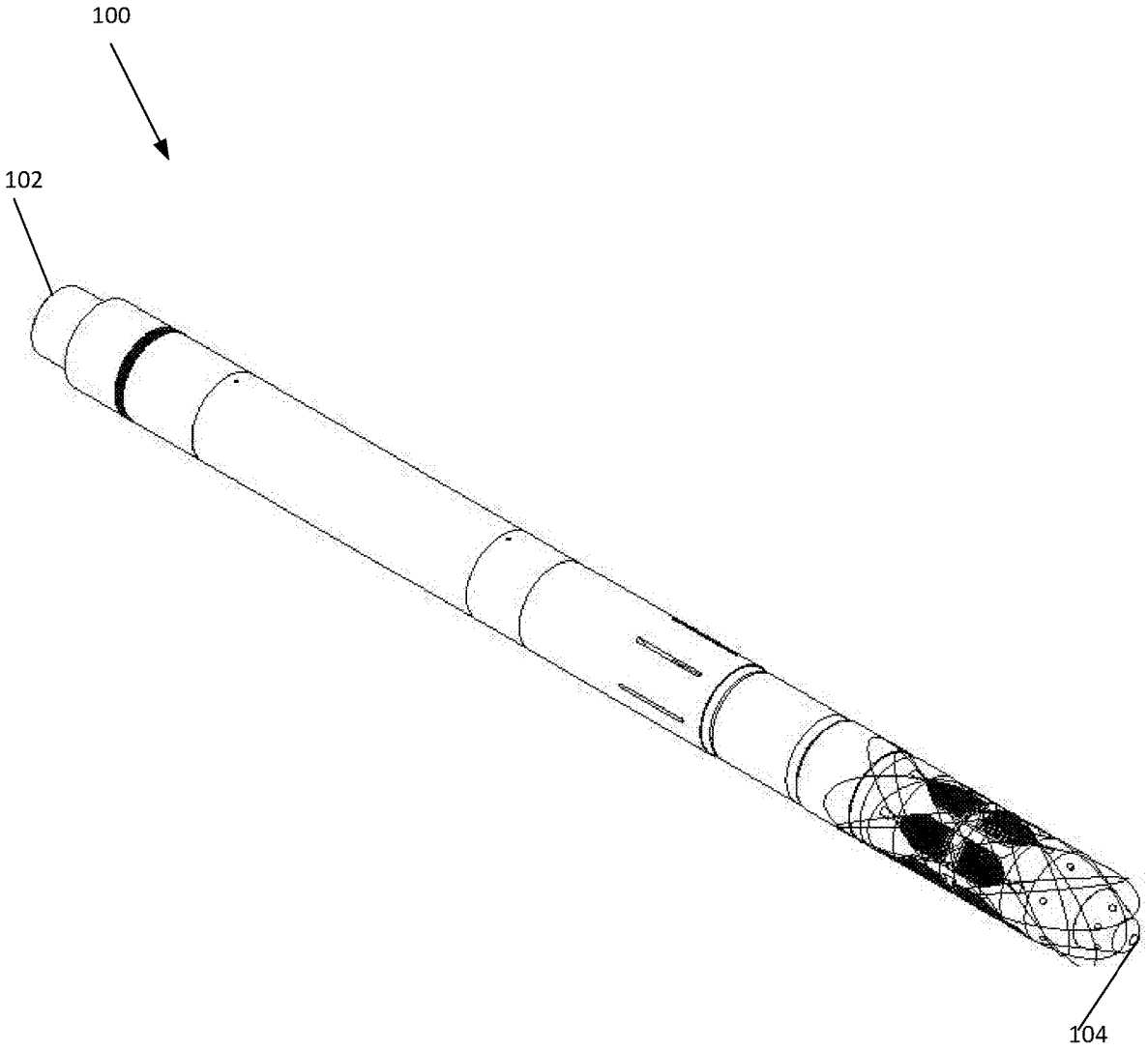
FIG. 1 depicts a resettable bridge plug, according to an embodiment.

Corresponding reference characters indicate corresponding components throughout the several views of the drawings. Skilled artisans will appreciate that elements in the figures are illustrated for simplicity and clarity and have not necessarily been drawn to scale. For example, the dimensions of some of the elements in the figures may be exaggerated relative to other elements to help improve understanding of various embodiments of the present disclosure. Also, common but well-understood elements that are useful or necessary in a commercially feasible embodiment are often not depicted in order to facilitate a less obstructed view of these various embodiments of the present disclosure.

DETAILED DESCRIPTION

In the following description, numerous specific details are set forth in order to provide a thorough understanding of the present invention. It will be apparent, however, to one having ordinary skill in the art that the specific detail need not be employed to practice the present invention. In other instances, well-known materials or methods have not been described in detail in order to avoid obscuring the present invention.

FIG. 1 depicts a resettable bridge plug 100, according to an embodiment. Bridge plug 100 may include a closed proximal end 102, and a partially opened distal end 104. Bridge plug 100 is configured to isolate a section of a wellbore. Bridge plug 100 may be utilized in fracturing a wellbore, wherein the same bridge plug 100 may be set and released at different locations for multiple cycles with a wireline run. Bridge plug 100 may also be utilized to detect casing leaks by setting and releasing bridge plug 100 at desired locations to pinpoint a location of the casing leak. Bridge plug 100 may be utilized to open and close multiple sleeves within the single wireline run based on a created pressure differential using bridge plug 100.

Figure 2:
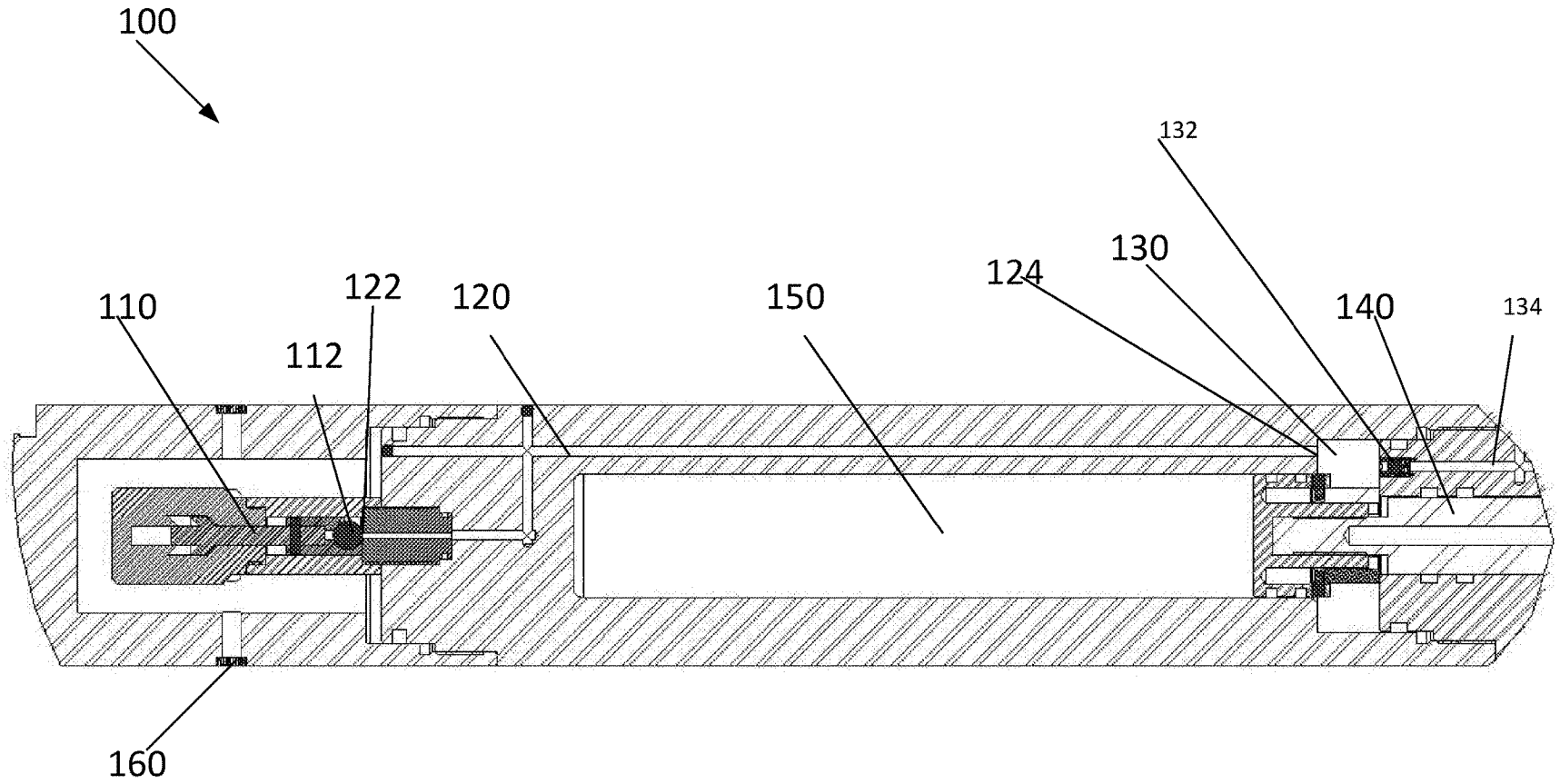
FIG. 2 depicts a bridge plug when s solenoid valve is deactivated, according to an embodiment.

As depicted in FIG. 2, bridge plug 100 may include solenoid valve 110, pathway 120, fill chamber 130, piston 140, spring chamber 150, and filter 160.

Solenoid valve 110 may be wirelessly connected or directly connected with a wire to a controller, such that solenoid valve 110 may be wirelessly controlled. Solenoid valve 100 may be configured to operate as a barrier between the well and pathway 120. Furthermore, solenoid valve 100 may be connected to a wireline, such that mechanical forces may be applied to the solenoid valve in a direction towards the surface of the wellbore. Solenoid valve 110 may be configured to open and close to allow fluid to enter fill chamber 130 via pathway 120, and be configured to close to restrict the movement of fluid into fill chamber. Solenoid valve 110 may include a regulator 112 that is configured to move to cover and uncover a proximal end 122 of pathway 120. Responsive to activating solenoid valve 110, regulator 112 may move away from proximal end 122, and fluid may enter the fill chamber 130. Responsive to deactivating solenoid valve 110, regulator 112 may cover proximal end 122 and limit, obstruct, not allow, etc. fluid to enter fill chamber 130. Furthermore, the wireless controller may be configured to wirelessly transmit a signal to deactivate the solenoid valve 110 and by applying a load towards the surface, which may expose the equalizing ports 550 and unset the elements of bridge plug 100, such as the packers and slips. In embodiments, solenoid valve 110 may include a burst disc that is configured to limit fluid from enter the valve chamber housing the solenoid valve until the disc is burst.

Pathway 120 may be a gun drilled hole through portions of bridge plug 110. Pathway 120 may have a proximal end 122 that is positioned above spring chamber 150, and a distal end 124 that is positioned below spring chamber 150. In embodiments, pathway 120 may be configured to enable fill chamber 130 to be in fluid communications with solenoid valve 110, wherein fluid may flow through pathway 120 into fill chamber 130.

Fill chamber 130 may be a compartment, cavity, etc. positioned at distal end 124 of pathway 120, wherein fill chamber 130 may be positioned closer to the distal end of bridge plug 100 than spring chamber 150. Fill chamber 130 may be configured to receive the fluid through pathway 120 to increase pressure 120 within fill chamber 130. Responsive to the pressure within the fill chamber being increased, via the received fluid, a pressure differential will create a pulling force on piston 140 to move the piston towards the proximal end of bridge plug 100, setting the elements of the bridge plug 100. For example, packers may radially expand across an annulus to perform a fracking operation.

Fill chamber 130 may include a check valve 132 and outlet port 134. Check valve 132 may be configured to allow fluid to flow out of fill chamber 132 responsive to solenoid valve 110 deactivating, pulling on the wireline, and moving piston 150 to its original position, wherein the movement of piston 150 to its original position (shown in FIG. 2) may allow the fluid within fill chamber 130 to be released into an annulus via outlet port 134.

Piston 140 may be a moveable rod with ports that is configured to move within bridge plug 100 based on a pressure differential between fill chamber 130 and spring chamber 150, which is changed based on the activation and deactivation of solenoid valve 110. In embodiments, responsive to activating solenoid valve 110, piston 140 may move towards a proximal end of bridge plug 100, which may set elements of bridge plug 100. Responsive to deactivating solenoid valve 110 and pulling on the wireline, which exposes equalization ports 550, piston may move towards a distal end of bridge plug 100, which may unset elements of bridge plug 100. Accordingly, by moving piston 140 within bridge plug 100, bridge plug 100 may be set an unset.

Spring chamber 150 may be positioned between the piston 140 and the solenoid valve 110. Spring chamber 150 may be configured to be filled with inert gas, such as nitrogen, or be a conventional spring to create a spring force on piston 140. The spring force may be utilized to maintain piston 140 in a location that is outside of spring chamber 150 when solenoid valve 110 is deactivated. Additionally, the spring force created by spring chamber 150 may be configured to assist in maintaining the elements of bridge plug 100 in an unset formation until solenoid valve 110 is activated. When solenoid valve 110 is activated, a pressure differential between a first pressure within the fill chamber 130 and a second pressure within the spring chamber 150 may be utilized to move piston 140 into portions of spring chamber 150. In embodiments, when the first pressure is less than the second pressure, the spring force may act on the piston 140, wherein the spring force limits the movement of the piston towards the proximal end of the bridge plug 100. Responsive to the first pressure being greater than the second pressure, the piston 150 may move towards the proximal end of the bridge plug 100. This movement of piston 150 may set the elements associated with bridge plug 100.

Filter 160 may be a device that is configured to filter, remove, limit, etc. undesirable elements from entering the bridge plug 100 from the annulus. In embodiments, filter 160 may be positioned at a location through the outer diameter of the bridge plug 100 corresponding to solenoid valve 110.

Embodiments may also include a burst disc. The burst disc may prevent fluid from entering the solenoid valve chamber until a required depth is reached. The burst disc may be configured to operate as an additional safety mechanism to prevent bridge plug 100 from presetting.

Figure 3:
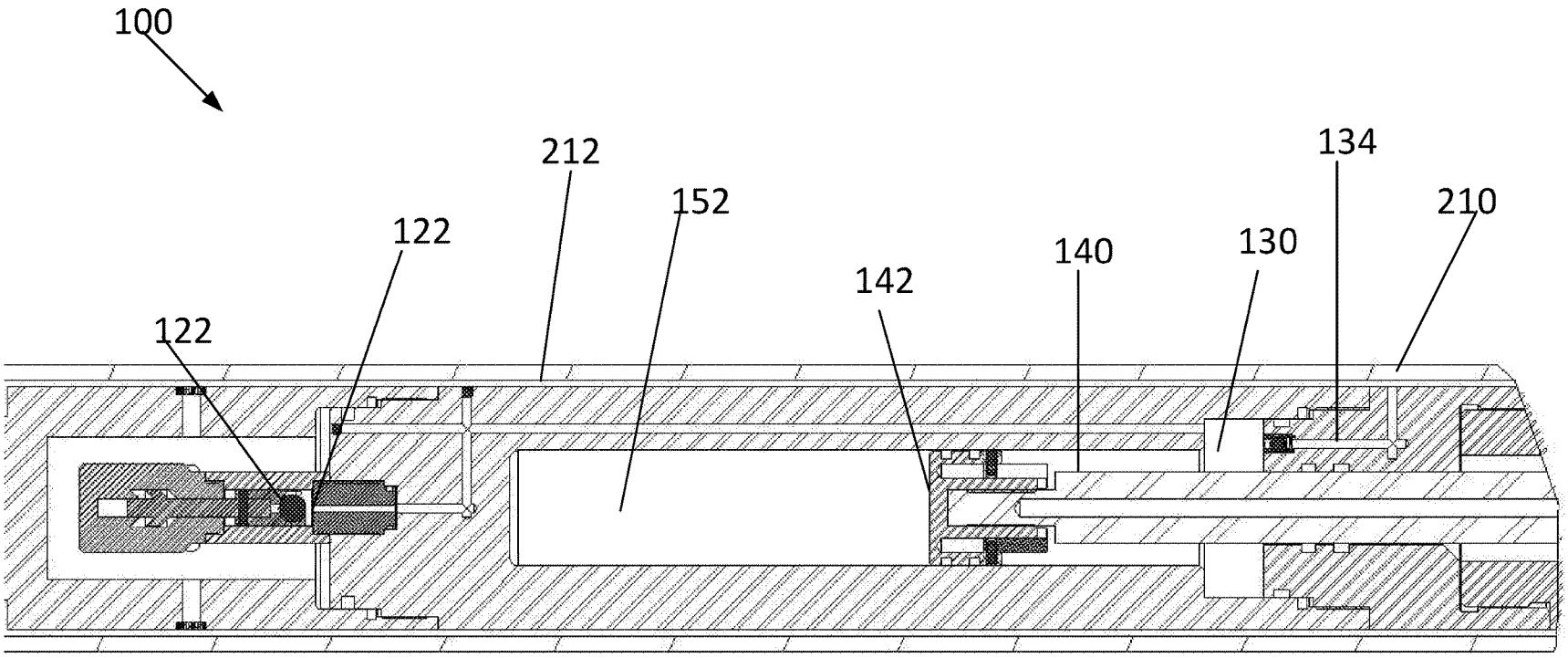
FIG. 3 depicts a bridge plug when a solenoid valve is activated, according to an embodiment.

FIG. 3 depicts bridge plug 100 when solenoid valve 110 is activated, according to an embodiment. Elements depicts in FIG. 3 may be described above, and for the sake of brevity another description of these elements is omitted.

As depicted in FIG. 3, when solenoid valve 110 wirelessly or via a wired connection receive a signal to activate, regulator 112 may be moved away from the proximal end 122 of pathway 120. This may enable fluid to flow through pathway 120 into fill chamber 130. Responsive to the fluid entering into fill chamber 130, the pressure differential between fill chamber 130 and spring chamber 150 may change from a negative value to a positive value to create a pulling force on piston 140.

Based on the pressure differential, a first end 142 of piston 140 may be moved within spring chamber 150. By embedding portions of piston 140 within spring chamber 150, the volume of spring chamber 150 may decrease, increasing the pressure within spring chamber 150 until a ratio between the pressures within spring chamber 150 and fill chamber 130 is leveled. When levelling the pressures, the movement of piston 140 may cease until solenoid valve 110 is deactivated.

When solenoid valve 110 is deactivated and the wireline is pulled, the fluid within fill chamber 130 may flow through the check valve and out of the corresponding ports into the annulus 212 between bridge plug 100 and casing 210.

Figure 4:
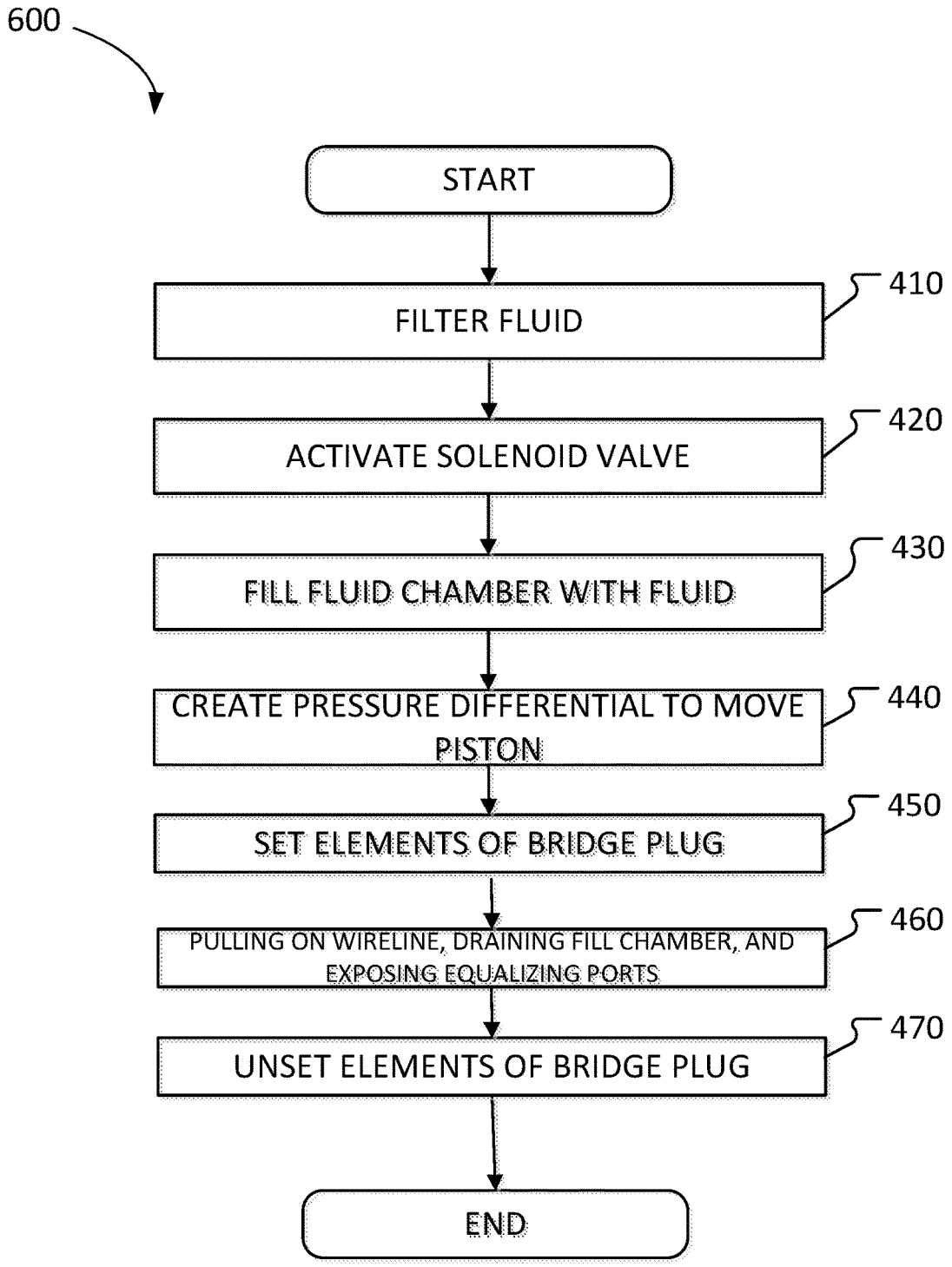
FIG. 4 depicts a method for setting and unsetting a bridge plug, according to an embodiment.

FIG. 4 depicts a method 400 for setting and unsetting a bridge plug, according to an embodiment. The operations of method 400 presented below are intended to be illustrative. In some embodiments, method 400 may be accomplished with one or more additional operations not described, and/or without one or more of the operations discussed. Additionally, the order in which the operations of method 400 are illustrated in FIG. 4 and described below is not intended to be limiting.

At operation 410, fluid from a wellbore may enter a bridge plug via a filter. When the fluid enters the bridge plug the filter may remove contaminants and other undesirable materials from the fluid.

At operation 420, a solenoid valve may wirelessly or via a wired connection receive instructions to activate the solenoid valve. When the solenoid valve is activated, a regulator may move from a closed positioned to an open position.

At operation 430, responsive to the solenoid valve being activated, fluid may flow into a fill chamber. This may increase the pressure within the fill chamber to being a value greater than a piston threshold. In embodiments, the piston threshold may be associated with a spring force within a spring chamber.

At operation 440, when the pressure within the fill chamber is greater than the piston threshold, a piston within the bridge plug may move towards a proximal end of the bridge plug.

At operation 450, based on the movement of the piston, packers and slips associated with the bridge plug may be deployed.

At operation 460, a solenoid valve may wirelessly receive instructions to deactivate, and the regulator may move from the open positioned to the closed position.

At operation 470, responsive to closing the regulator associated with the solenoid valve, a check valve associated with the fill chamber may open due to a pulling load on the wireline that is in communication with the check valve. This may allow the fluid within the fill chamber to exit the fill chamber, decreasing the pressure within the fill chamber below the piston threshold. When the pressure within the fill chamber is below the piston threshold and due to the expose of the equalization ports, the piston may move towards the distal end of the bridge plug. Moving the piston may retract the packers and slips allowing the bridge plug to be repositioned within the well.

Figure 5:
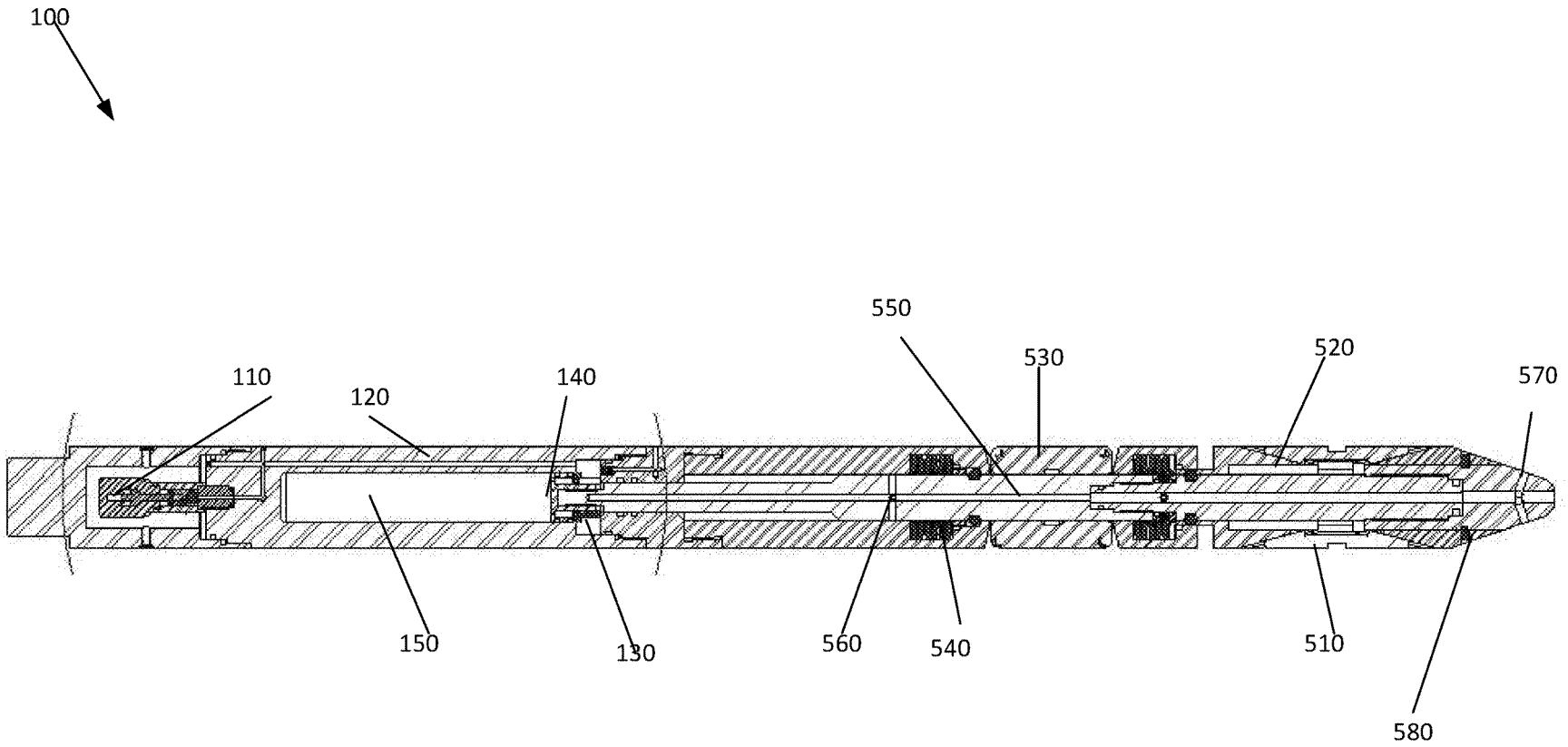
FIG. 5 depicts an expanded view of a bridge plug wherein solenoid valve is deactivated, according to an embodiment.

FIG. 5 depicts an expanded view of bridge plug 100 wherein solenoid valve is deactivated, according to an embodiment. Elements depicts in FIG. 5 may be described above, and for the sake of brevity another description of these elements is omitted.

As depicted in FIG. 5, bridge plug 100 may include slips 510, slip release spring 520, packers 530, load release device 540, equalization port 550 with proximal end 560 and distal end 570, and secondary release 580.

Slips 510 may be positioned more proximate to the distal end of the bridge plug 100 than packers 530. Slips 510 may be configured to extend across the annulus to form an anchor for the bridge plug 100 within casing, wherein slips 510 may move responsive to the piston moving into the spring chamber 150 (i.e. the pressure differential between fill chamber 130 and spring chamber 150). Slips 510 may include vertically adjustable members, such as slip release spring 520, that are configured to assist in unsetting slips 510. In embodiments, slip release spring 520 may be configured to apply a load force on the piston and slips 510 towards the distal end of bridge plug 510. As such, responsive to the pressure differential within the fill chamber and nitrogen chamber being somewhat equal, the slip release spring 520 may assist in resetting slips 510.

Packers 530 may be sealing elements that are configured to seal radially across the annulus. In embodiments, while the solenoid valve is deactivated, packers 530 may not seal across an annulus. While the solenoid valve is activated, packers 530 may be configured to seal across the annulus. Accordingly, packers 530 may set an unset based on the pressure differential between fill chamber 130 and spring chamber 150, and the corresponding movements of piston 140.

Load release device 540 may be a spring that is configured to ensure that slips 510 and/or packers 530 are not prematurely set or unset, such that load release device 540 may act as a shear screw. Load release device 540 may include a locking mechanism that inhibits the movement of packers 530 and/or slips until a predetermined pressure is applied to load release device 540.

Equalization port 550 may include a proximal end 560 positioned above packers 530 and a distal end 570 positioned below slips 520. Equalization port 550 may be configured to equalize the pressure in the tool in for locations above and below slips 510 and packers 530. This may assist in unsetting the elements associated with bridge plug 100.

Secondary release mechanism 580 may be a device that is configured to assist in releasing the elements of bridge plug 100 if they do not release as intended. Secondary release mechanism 580 may include shear screws that shear at a certain load. In embodiments, when the load applied by the wireline is above a wireline threshold, the secondary release mechanism 580 may shear. This may not allow slip release spring 520 to apply pressure to slips 510, and automatically release slips 510.

Figure 6:
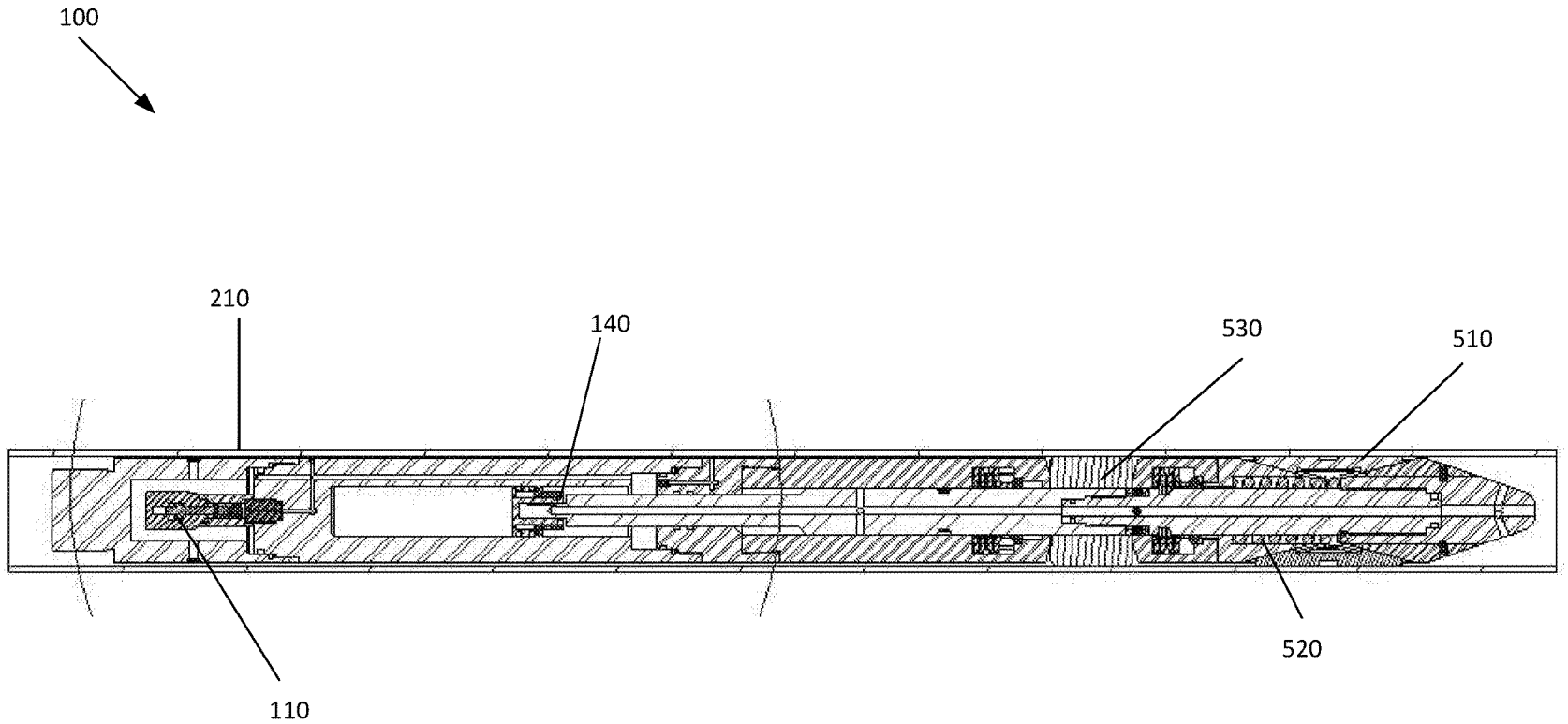
FIG. 6 depicts an expanded view of a bridge plug wherein solenoid valve is activated, according to an embodiment.

FIG. 6 depicts an expanded view of bridge plug 100 wherein solenoid valve is activated, according to an embodiment. Elements depicts in FIG. 6 may be described above, and for the sake of brevity another description of these elements is omitted.

As depicted in FIG. 6, when solenoid valve 110 is activated, packers 530 and slips 510 may extend across the annulus and be positioned adjacent to casing 210.

Figure 7:
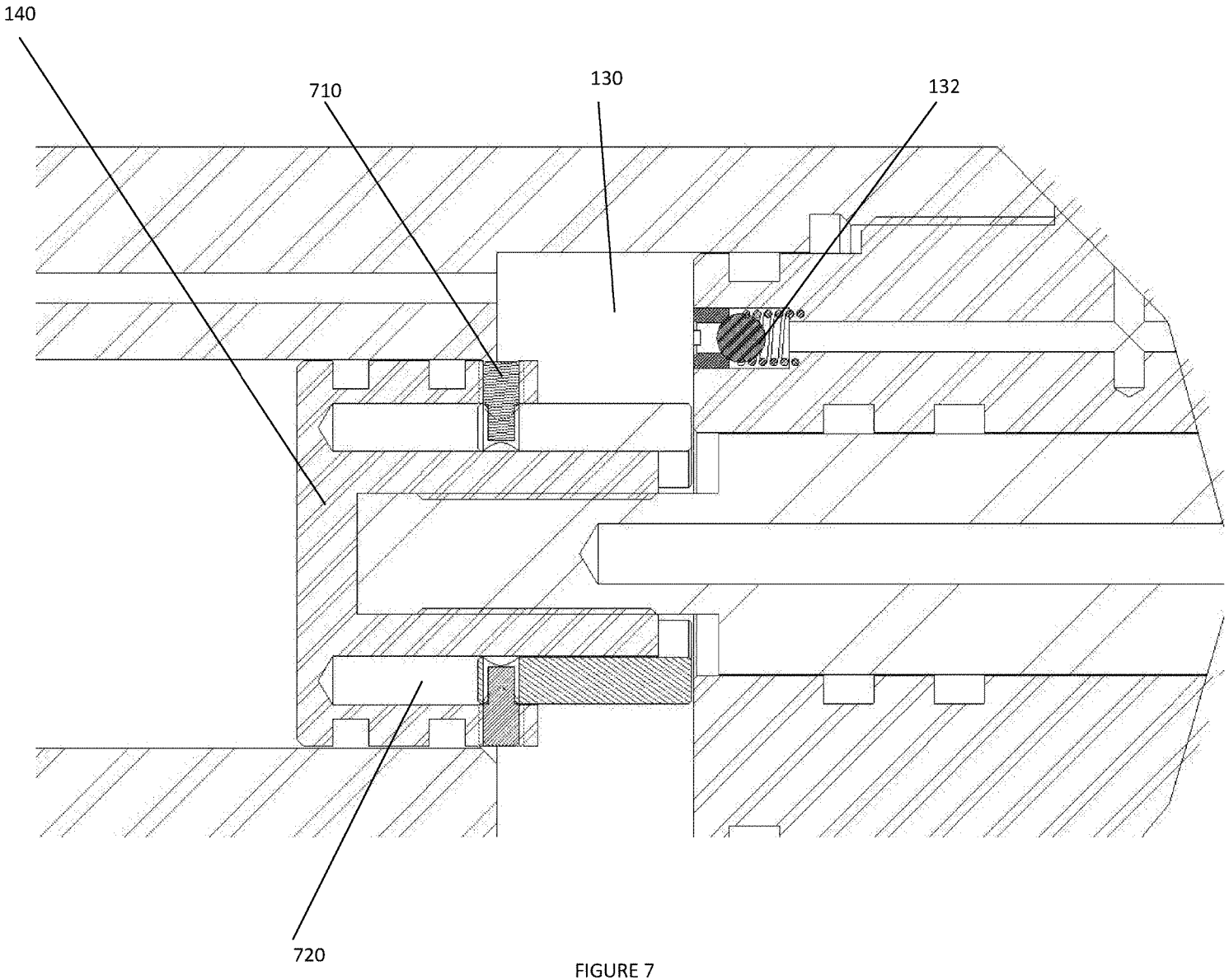
FIG. 7 depicts a detailed view of a proximal end of a piston that is configured to operate as a tertiary releasing device, according to an embodiment.

FIG. 7 depicts a detailed view of a proximal end of piston 140 that is configured to operate as a tertiary releasing device, according to an embodiment. Elements depicts in FIG. 7 may be described above, and for the sake of brevity another description of these elements is omitted. The proximal end of piston 140 may include shear screws 710 and tertiary release pins 720.

The tertiary releasing device may be configured to operate when the secondary release device has inadvertently not been deployed and the elements of bridge plug 100 have not been reset based on deactivating the solenoid valve. Shear screws may be configured to shear at a tertiary load, wherein the tertiary load is greater than the load associated with the secondary release device. In embodiments, when the load applied by the wireline is above tertiary load, the shear screws 710 may shear.

Responsive to shearing screws 710, release pins 720 may move allowing the exposure of spring chamber 150 to fluids within fill chamber 130. This may equalize the pressure between the two chambers, helping unsetting the elements of bridge plug 100.

In embodiments, once the secondary and tertiary releasing devices have been employed, bridge plug 100 may not be reset.

Figure 8:
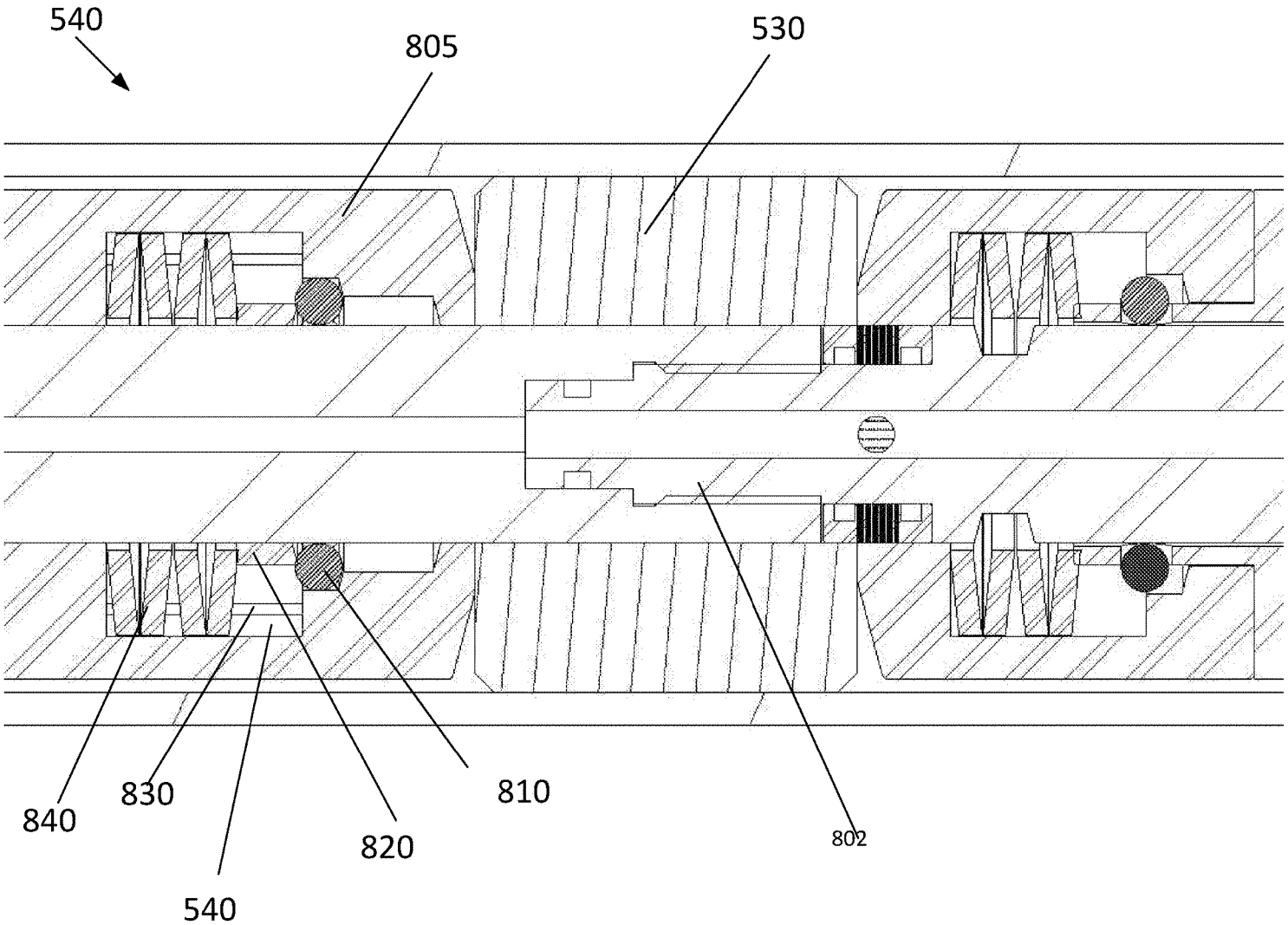
FIG. 8 depicts a detailed view of a load release device, according to an embodiment.

FIG. 8 depicts a detailed view of load release device 540, according to an embodiment. Elements depicts in FIG. 8 may be described above, and for the sake of brevity another description of these elements is omitted.

As depicted in FIG. 8, load release device 540 may include housing 805 with ball bearings 810, push ring 820, recess 830, and disc springs 840.

Load release device may be configured to ensure that the elements of bridge plug 100 are no inadvertently deployed, and also configured to act like a shearing device.

In embodiments, responsive to the solenoid valve being activated and the piston moving the with the spring chamber, such that the spring chamber has a desired load, the mandrel 802 may also attempt to move relative to the stationary housing 805. However, mandrel 805 may not move due to ball bearings 810 pushing against push ring 820, while push ring 820 pushes against disc springs 840, which may compress based on the force.

Yet, at a certain load, disc spring 840 may compress sufficiently, which may allow ball bearing 810 to be positioned within recess 830. This may release the lock created by load release device 540 on mandrel 802, allowing mandrel 802 to move. However, the movement of mandrel 802 may not occur until the desired force is created on disc springs 840 to allow ball bearing 810 to be repositioned within recess 830. Responsive to the force applied to disc springs 840 being below a given threshold, disc springs 840 may elongate, applying pressure on push ring 820 to move ball bearings 810 to their original position.

Reference throughout this specification to "one embodiment", "an embodiment", "one example" or "an example" means that a particular feature, structure or characteristic described in connection with the embodiment or example is included in at least one embodiment of the present invention. Thus, appearances of the phrases "in one embodiment", "in an embodiment", "one example" or "an example" in various places throughout this specification are not necessarily all referring to the same embodiment or example. Furthermore, the particular features, structures or characteristics may be combined in any suitable combinations and/or sub-combinations in one or more embodiments or examples. In addition, it is appreciated that the figures provided herewith are for explanation purposes to persons ordinarily skilled in the art and that the drawings are not necessarily drawn to scale.

Although the present technology has been described in detail for the purpose of illustration based on what is currently considered to be the most practical and preferred implementations, it is to be understood that such detail is solely for that purpose and that the technology is not limited to the disclosed implementations, but, on the contrary, is intended to cover modifications and equivalent arrangements that are within the spirit and scope of the appended claims. For example, it is to be understood that the present technology contemplates that, to the extent possible, one or more features of any implementation can be combined with one or more features of any other implementation.

What is claimed is:

1. A resettable bridge plug comprising:

a solenoid valve configured to receive signals to open and close a regulator;

a fill chamber configured to receive fluid from the solenoid valve when the solenoid valve is open, the fill chamber having a dynamic first pressure, wherein the first pressure varies based on an amount of fluid within the fill chamber;

a spring chamber configured to apply a first force towards a distal end of the spring chamber, the spring chamber having a second pressure;

a piston positioned within the bridge plug, the piston being configured to move based on a pressure differential between the first pressure and the second pressure;

a secondary release mechanism connected to slips, the secondary release mechanism including first shear screws that shear responsive to a first load being applied to a wireline connected to the bridge plug.

2. The resettable bridge plug of claim 1, further comprising:

a packer that is configured to expand responsive to the piston moving towards a proximal end of the bridge plug, and the packer being configured to retract responsive to the piston moving towards a distal end of the bridge plug.

3. The resettable bridge plug of claim 1, further comprising:

a filter that is configured to filter fluids entering the bridge plug before the fluids enter the fill chamber.

4. The resettable bridge plug of claim 1, further comprising:

a tertiary release mechanism associated with the spring chamber and the fill chamber, wherein responsive to shearing second shear screws the pressure differential between the fill chamber and the spring chamber equalizes.

5. The resettable bridge plug of claim 1, wherein the spring chamber creates a spring force.

6. A resettable bridge plug comprising:

a solenoid valve configured to receive signals to open and close a regulator;

a fill chamber configured to receive fluid from the solenoid valve when the solenoid valve is open, the fill chamber having a dynamic first pressure, wherein the first pressure varies based on an amount of fluid within the fill chamber;

a spring chamber configured to apply a first force towards a distal end of the spring chamber, the spring chamber having a second pressure;

a piston positioned within the bridge plug, the piston being configured to move based on a pressure differential between the first pressure and the second pressure;

a load release device configured to apply a second force against the piston, the load release device including a ball bearing, disc spring, and recess, wherein the first force is in the same direction as the second force.

7. The resettable bridge plug of claim 6, wherein the ball bearing is positioned in the recess when the solenoid valve is opened.

8. The resettable bridge plug of claim 6, wherein the ball bearing applies pressure against the disc spring when the solenoid valve is closed.

9. A method associated with a resettable bridge plug comprising:

receiving control signals to open and close a solenoid valve;

receiving fluid within a fill chamber responsive to opening the solenoid valve, wherein a first pressure within the fill chamber increases when fluid enters the fill chamber;

creating a force towards a distal end of the bridge plug via a spring chamber, the spring chamber having a second pressure;

receiving, by a piston positioned within the bridge plug, the force applied by the second pressure within the spring chamber;

moving the piston based on a pressure differential between the first pressure and the second pressure;

shearing first shear screws within a secondary release mechanism associated with slips, wherein the first shear screws shear responsive to a first load being applied to a wireline connected to the bridge plug.

10. The method of claim 9, further comprising:

expanding a packer responsive to the piston moving towards a proximal end of the bridge plug; and retracting the packer being responsive to the piston moving towards the distal end of the bridge plug.

11. The method of claim 9, further comprising:

filtering, via a filter, fluids entering the bridge plug before the fluids enter the fill chamber.

12. The method of claim 9, further comprising:

shearing secondary shear screws within a tertiary release mechanism associated with the spring chamber and the fill chamber;

equalizing the pressure differential between the fill chamber and the spring chamber responsive to shearing the secondary shear screws.

13. The method of claim 9, further comprising:

applying, via a load release device, a second force against the piston, the load release device including a ball bearing, disc spring, and recess, wherein the first force is in the same direction as the second force.

14. The method of claim 13, wherein the ball bearing is positioned in the recess when the solenoid valve is opened.

15. The method of claim 13, wherein the ball bearing applied pressure against the disc spring when the solenoid valve is closed.

16. The method of claim 9, wherein the spring chamber creates a spring force.

* * * * *